United States Patent [19]

Green et al.

[11] Patent Number: 4,975,045

[45] **Date of Patent: * Dec. 4, 1990**

[54] BURNER REGISTER WITH DUAL INLET AIR VALVES

[75] Inventors: George K. Green, Kendale, N.Y.; Landy Chung, Ashtabula, Ohio

[73] Assignee: Eagleair, Inc., Bethlehem, Pa.

[ * ] Notice: The portion of the term of this patent subsequent to Jul. 21, 2004 has been disclaimed.

[21] Appl. No.: 854,791

[22] Filed: Apr. 23, 1986

[51] Int. Cl.[5] ..... F23M 9/00

[52] U.S. Cl. ..... 431/183; 431/182; 239/402; 239/406

[58] Field of Search ..... 431/183, 184, 182; 239/402, 402.5, 406; 110/264, 265

[56] References Cited

U.S. PATENT DOCUMENTS

| | | | |
|---|---|---|---|
| 1,235,855 | 8/1917 | Stillman, Jr. . | |
| 1,519,846 | 12/1924 | Kleffel . | |
| 1,843,662 | 2/1932 | Craig et al. . | |
| 2,087,869 | 7/1937 | Blodgett . | |
| 2,269,062 | 10/1941 | Stillman | 431/184 |
| 2,320,576 | 6/1943 | Dunn . | |
| 2,325,442 | 7/1943 | Vroom . | |
| 2,515,813 | 7/1950 | Wiant . | |
| 4,500,282 | 2/1985 | Eschenko et al. . | |
| 4,504,216 | 3/1985 | Hager et al. | 431/183 |
| 4,681,532 | 7/1987 | Chung | 431/183 |

FOREIGN PATENT DOCUMENTS

| | | |
|---|---|---|
| 160312 | 3/1921 | United Kingdom . |
| 183874 | 8/1922 | United Kingdom . |
| 1389428 | 6/1927 | United Kingdom . |
| 325920 | 3/1930 | United Kingdom . |
| 372350 | 5/1932 | United Kingdom . |
| 392782 | 5/1933 | United Kingdom . |
| 917404 | 2/1963 | United Kingdom . |
| 1162445 | 8/1969 | United Kingdom . |
| 1177216 | 1/1970 | United Kingdom . |
| 1276108 | 6/1972 | United Kingdom . |

*Primary Examiner*—Carroll B. Dority

*Attorney, Agent, or Firm*—Foley & Lardner, Schwartz, Jeffery, Schwaab, Mack, Blumenthal & Evans

[57] ABSTRACT

A burner register assembly is provided for controlling a supply of secondary air to a furnace having a fuel and primary air supply and a secondary air supply. The burner register assembly includes a body and a pair of air valves in the body for communication with the secondary air supply to control the admission of secondary air to the register assembly. Each air valve communicates with a scroll section in the burner register body, which scroll section has a scroll passageway which spirals inwardly in the direction of secondary air flow to provide a controlled flow pattern of secondary air into the furnace. The air valve is disposed upstream of the scroll section with which it communicates and thus is well removed from the extreme environment of the opening or throat to the furnace. The burner register assembly also includes a shadow vane assembly positioned proximate to the outlet of the register, i.e., proximate to the furnace throat, to provide protection form radiant heat from the furnance. The shadow vane assembly includes a set of radially outwardly extending circumferentially arranged air foil-shaped vanes and a cooling passage associated with each vane.

3 Claims, 3 Drawing Sheets

BURNER REGISTER WITH DUAL INLET AIR VALVES

FIELD OF THE INVENTION

The present invention relates to the introduction of fuel and combustion air into a furnace, such as the type of furnace which fires a boiler in a power plant of an electric utility. Specifically, the present invention relates to a burner register assembly for use in a furnace.

BACKGROUND OF THE INVENTION

The present invention is primarily directed to coal-fired furnaces, although it will be understood that the invention may also be used with oil-fired furnaces, hybrid coal/oil furnaces, gas-fired furnaces and furnaces which burn other materials. It should therefore be understood that, while the description which follows is directed to pulverized coalburning furnaces, this is by way of example only and not a limitation. The present invention is generally applicable to any furnace requiring excess air to assure complete combustion or furnaces requiring excess air as load is reduced.

Typical prior art burner arrangements for a furnace include a burner or coal nozzle through which pulverized coal and primary air are introduced into the furnace. The primary air typically supplies only about 20 percent of the air needed to fully oxidize the fuel Therefore, each burner nozzle is provided with a secondary air supply. The secondary air supply typically uses a "windbox" or air plenum which is in communication with a burner register.

The prior art burner registers are of two general types.

The first type utilizes pivoting slat vanes journaled between two ring members to form a band. The coal nozzle is centrally located along the axis of the band. The vanes pivot from a fully closed position, where the end of one slat coincides with the beginning of the next thus forming a closed ring about the fuel nozzle, to an open position where the vanes are positioned generally radially with respect to the fuel nozzle, thus permitting the free flow of secondary air. Such a register utilizes a single assembly to perform the dual functions of controlling both the volume and direction of the secondary air supply. An example of such a register is taught in Chapter 9 of "Steam/Its Generation and Use" by the Babcock and Wilcox Company, 1978 Edition, which is hereby incorporated by reference.

The second type of prior art secondary air register is formed from a plurality of movable, radial "pie" shaped wedges which in the closed position form a closed circular valve surface and which, as opened, operates to control the volume and direction of secondary air introduced from an associated windbox into the furnace along with the fuel and primary air. These prior art arrangements suffer from various deficiencies, discussed below.

Owing to their considerable number of required interrelated moving parts, which were subjected to the severe environmental conditions existing in the space adjacent to the furnace, the prior art register were unreliable and subject to frequent and costly repair efforts. These repairs would require the shutting down of the furnace facility at considerable expense and inconvenience to the operator of the furnace (usually an electrical generation utility.)

In addition, the prior art registers introduced secondary air into the furnace in a turbulent but generally random pattern with only a small and ineffective swirl component. This led to the incomplete combustion of the fuel and to erosion of the furnace walls in the vicinity of the burner due to the action of deposits of only partially burned fuel along the furnace walls Moreover, the prior art register required the introduction of large amounts of secondary air even when the burner was idle in order to protect the register from heat damage This required that the furnace be equipped with the capacity to generate and otherwise process large amounts of secondary air and led to the problem of erosion or wear damage occurring in the various furnace components exposed to the higher velocity air flow (e.g., fans, registers, heat exchangers, superheaters, etc.) It is noted that the wear resulting from the gas flow against the elements in the flow path is a function of the cube of the gas velocity.

The operation of prior art registers resulted in inefficient furnace operation, especially at low loads. Moreover, due to the lack of a well defined fuel/air flow pattern, there was a tendency in prior art furnaces for the intense heat and pressure variations existing in the furnace to cause the fuel from the nozzle to be "blown" against the relatively cold furnace walls. This resulted in poor combustion of the coal and additional damage to the furnace walls.

U.S. Pat. No. 4,504,216 to Hagar et al is directed to the foregoing problems. The present invention represents a variation on the particular preferred embodiment disclosed in said U.S. Pat. No. 4,504,216, which patent is hereby incorporated herein by reference.

SUMMARY OF THE INVENTION

It is an object of the present invention to provide an improved device for supplying secondary air to a furnace.

It is a further object of the present invention to provide a device for controlling both the volume and flow pattern of the secondary air to a furnace burner.

It is a still further object of the present invention to provide a furnace burner register assembly having a decreased pressure drop.

It is yet a further object of the present invention to provide a furnace burner register assembly which will decrease the rate of erosion of the furnace walls.

Another object of the present invention is to provide a furnace burner register assembly which will retain fuel particles in a controlled air flow to improve combustion.

It is a still further object of the present invention to provide a furnace burner register assembly which will operate to form the secondary air into a controlled pattern.

It is a further object of the present invention to provide a durance burner register which is economical in the use of secondary air.

It is a still further object of the present invention to provide a furnace burner register of durable but simple design and construction so as to be reliable in operation.

It is a still further object of the present invention to provide a furnace burner register assembly which requires a reduced amount of secondary air to cool the burner register when the burner is idle.

It is yet another object of the present invention to provide a furnace burner register assembly which enhances the efficiency of the furnace thus resulting in the use of less fuel to produce a given amount of heat and the generation of fewer objectionable effluents.

In accordance with the present invention, a burner register assembly is provided for controlling a supply of secondary air to a furnace having a fuel and primary air supply and a secondary air supply. The burner register assembly includes a body and a pair of air valves in the body for communication with the secondary air supply for controlling the admission of secondary air to the register assembly. Each air valve communicates with a scroll section in the burner register body. The scroll section has a scroll passageway which spirals inwardly in the direction of secondary air flow to effect a controlled flow pattern of secondary air into the furnace. Each air valve is disposed upstream of the scroll section with which it communicates and thus is well removed from the extreme environment of the opening or throat to the furnace. That is, each air valve is disposed well away from the very high temperatures at the throat to the furnace and well away from the sooty deposits which will accumulate on the equipment near the throat to the furnace, i.e., near the outlet of the register.

The burner register includes a shadow vane assembly positioned proximate to the outlet of the register, i.e., proximate to the furnace throat, to provide protection from radiant heat from the furnace. The shadow vane assembly includes a set of radially outwardly extending circumferentially arranged air foil-shaped vanes and a cooling passage associated with each vane. Each cooling passage communicates with the supply of secondary air, whereby secondary air flows through the cooling air passages to cool the vanes of the shadow vane assembly and thereby ensure that the shadow vane assembly will not itself be damaged by radiant heat from the furnace.

BRIEF DESCRIPTION OF THE DRAWINGS

The accompanying drawings, which are incorporated in and form a part of the specification, illustrate the preferred embodiment of the present invention and, together with the description, serve to explain the principles of the present invention. Like elements are similarly numbered in the various drawings. In the drawings.

DETAIL DESCRIPTION OF PREFERRED EMBODIMENTS

Figure 1:
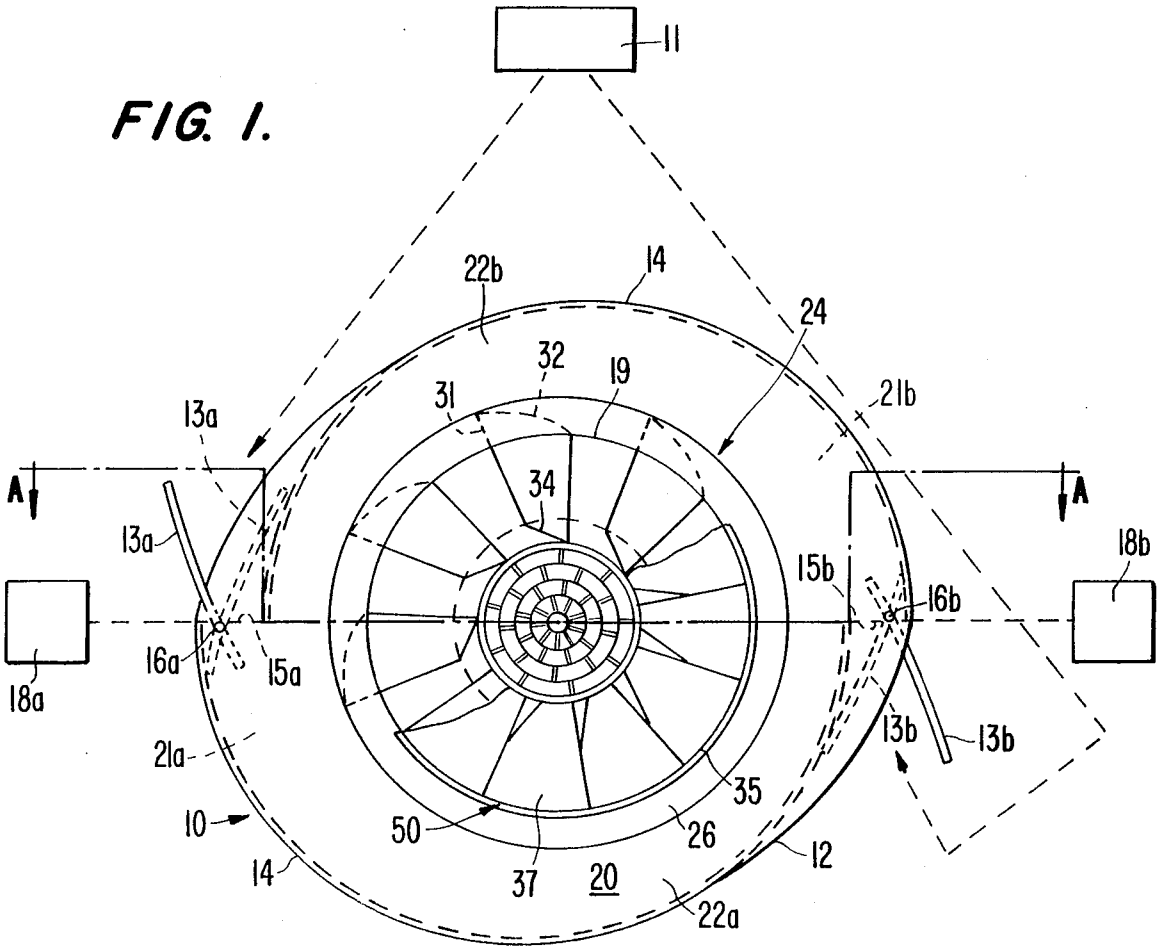
FIG. 1 is a plan view, in partial section, of a burner register assembly in accordance with the present invention.
Figure 2:
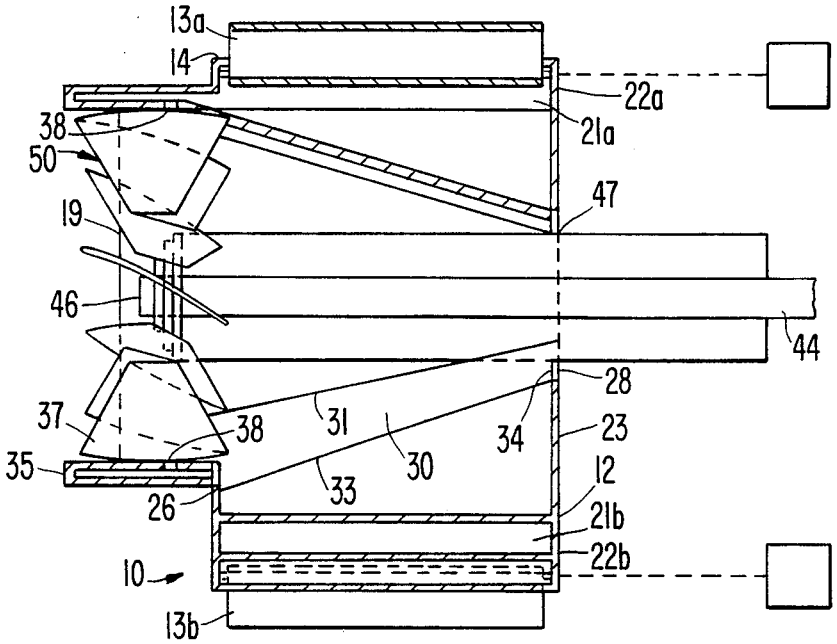
FIG. 2 is a cross sectional view taken on the line A—A of FIG. 1, of a burner register assembly in accordance with the present invention.
Figure 4:
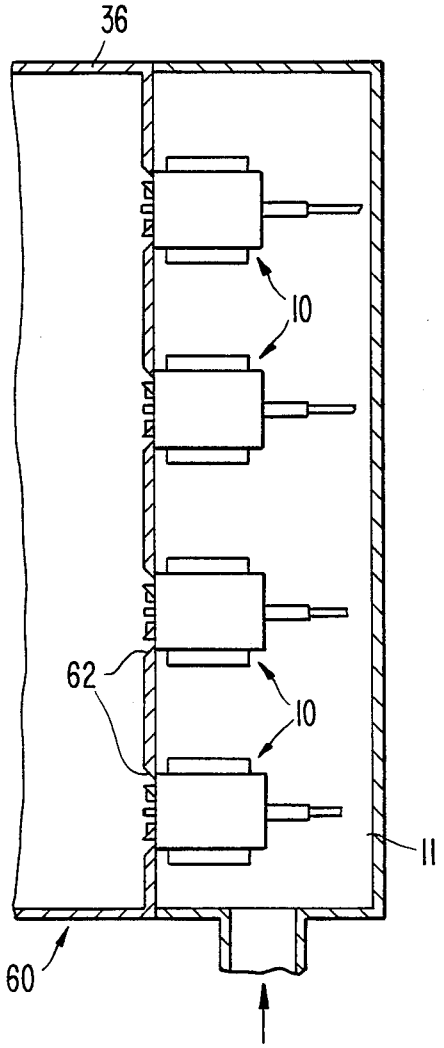
FIG. 4 is a side elevation, partly in section, showing a plurality of burner registers according to the present invention mounted with respect to a furnace and windbox.

Turning first to FIGS. 1 and 2, reference numeral 10 generally depicts an air register assembly according to the present invention. Air register assembly 10 is adapted to be used in a furnace 60 (FIG. 4) having a secondary air supply plenum or windbox 11 and heat exchange-type furnace walls 36 into which a number of air register assemblies 10 are intended to be fit. Secondary air enters each burner register assembly 10 from windbox 11. Windbox 11 is shown schematically in FIG. 1 in which broken line arrows depict the flow of air from windbox 11 into dual inlets 15*a*, 15*b* in the burner register assembly 10.

Each burner register assembly includes a body 12 having a generally curved configuration as can be best seen in FIG. 1. That is, body 12 of each burner register assembly has a roughly cylindrical shape but includes inwardly spiraling walls as will be described in more detail later. A pair of air valves 13*a*, 13*b* are disposed in body 12 for communication with the secondary air supply from windbox 11 for controlling the admission of secondary air to the burner register assembly 10. That is, secondary air enters the burner register assembly 10 through air valves 13*a*, 13*b*. Air valves 13*a*, 13*b* are used to control the volume of air to the burner register assembly 10 and preferably take the form of simple butterfly valve members with curved configurations as shown in FIG. 1. The curved configurations of valves 13*a*, 13*b* enables them to provide a streamlined and aerodynamic extension of the spiraling walls of body 12.

In FIG. 1, the solid line dispositions for valves 13*a*, 13*b* show a wide-open condition of valves 13*a*, 13*b* for achieving maximum or near-maximum ingestion of secondary air from the windbox 11. The phantom line positions shown for air valves 13*a*, 13*b* in FIG. 1 depict the valves in a closed position for blocking off the flow of secondary air to the register 10. Valves 13*a*, 13*b* are movable between the closed and wideopen positions depicted in FIG. 1 and may be adjusted to various positions therebetween to control and regulate the flow of secondary air through the burner register assembly 10.

Body 12 includes a curved outer cover 14 having a rounded, roughly cylindrical, but somewhat inwardly spiraling shape. As already alluded to, the curvature of air valves 13*a*, 13*b* corresponds generally with the curvature of outer cover 14.

Air valves 13*a*, 13*b* control the flow of secondary air through a pair of inlets 15*a*, 15*b*. Specifically, body 12 has a pair of inlets 15*a*, 15*b* through which inlet secondary air flows during operation. Air valve 13*a* pivots about an axis 16*a* to control the flow of secondary air through inlet 15*a*. Likewise, air valve 13*b* pivots about axis 16*b* to control the flow of air through inlet 15*b*. The pivoting action about axes 16*a*, 16*b* is effected by a pair of actuators 18*a*, 18*b* shown schematically in FIG. 1. Actuator 18*a* controls air valve 13*a* and actuator 18*b* controls air valve 13*b*. Actuators 18*a*, 18*b* may be mechanical, electrical, hydraulic or pneumatic and may be controlled automatically in response to detected parameters, such as mass flow rate, temperature, oxygen content, etc., or may be manually controlled. Air valves 13*a*, 13*b* are preferably provided with gaskets or seals to effect sealing of the valves 13*a*, 13*b* with respect to the body 12 when required.

Body 12 also has an outlet 19 through which secondary air is discharged to the furnace during operation.

Returning to the description of the inlet side of the burner register assembly 10, after secondary air passes through inlets 15*a*, 15*b* and valves 13*a*, 13*b*, it travels through spiral passageways 21*a*, 21*b* which spiral toward the center of the air register assembly and which have ever-decreasing cross sections Thus, secondary air passing through inlet 15*a* at which air valve 13*a* is located then travels through inwardly spiraling passageway 21*a*. Likewise, secondary air passing through inlet 15*b* at which air valve 13*b* is located travels through inwardly spiraling passageway 21*b*.

Spiral passageway 21*a* is defined by scroll section 22*a* in body 12 of the air register 10. Likewise, spiral passageway 21*b* is defined by scroll section 22*b* in body 12. Body 12 includes a front cover 20 and a rear cover 23 joined by outer cover 14, which covers contribute to defining scroll sections 22*a*, 22*b*. As will be seen from the drawing, each "scroll" section 22*a*, 22*b* defines a spiral passageway 21*a*, 21*b* in which the upstream part of the passageway is at the outer part of the spiral and the downstream part of the passageway is at the inner part of the spiral. These passageways each converge from a relatively large cross-sectional area (with respect to its axis) at the outer part of the spiral to a relatively small cross-sectional area at the inner part of the spiral. That is, each scroll section has the shape of a nautilus shell. While traversing the scroll section, air is uniformly distributed about outlet 19 and about a swirl vane assembly generally referred to by reference numeral 24. At the same time, the secondary air, while traversing the scroll, is simultaneously accelerated in an angular direction to impart a swirling movement to the air.

The swirl vane assembly 24 preferably includes front and rear mounting rings 26 and 28, respectively, between which are mounted a plurality of elongated, arcuate, tapered vanes 30. The vanes are preferably fixed between the rings 26 and 28 and are designed to impart a well-organized swirling flow to the secondary air. It is to be noted that the scroll sections 22*a*, 22*b* themselves, as controlled by their valves 13*a*, 13*b*, provide the well-organized, evenly distributed spiral air flow about the outlet 19 and that the swirl vane register assembly 24 simply enhances and maintains this organized flow. The organized vortex pattern of secondary air flow will remain well defined at flow rates ranging from 0.1 to over twice the nominal secondary air flow.

The vanes 30 each include a leading edge 31 disposed along what will be the upstream side of the blade, an axially forward edge 32 which is mounted at an angle with respect to mounting ring 26, and an axially rearward edge 34 which is mounted in an angle with respect to mounting ring 28. Vanes 30 are preferably configured such that the leading edge 31 is parallel to the incoming secondary air flow. The vanes are disposed at an angle to the axis of the overall air register assembly 10 so as to continue to maintain and contribute to the well-organized vortex flow of secondary air as induced by the scroll sections 22*a*, 22*b*. As viewed from the left side in FIG. 2, the edges 31 and 33 will converge at the axis of the register. The angle included by the leading and trailing edges 31 and 33 of each vane 30 may be on the order of about 4–45° and preferably in the range of 6–25°.

Positioned adjacent the front mounting ring 28 and front cover 20 and disposed at outlet 19 is shadow vane assembly 50. The shadow vane assembly includes a hollow mounting ring 35. Mounting ring 35 is adapted to be positioned along a furnace wall 36 (FIG. 4) and specifically to be positioned in registry with an opening or throat 62 into the furnace 60. Mounting ring 35 supports a set of shadow vanes 37 which are disposed circumferentially about ring 35. The shadow vanes 37 protect the air register assembly 10 with its swirl vane assembly 24 from the radiant heat of the furnace and may also contribute to the continued maintenance and organization of the vortex flow which is evenly distributed about the outlet 19.

When viewed directly along the axis of the burner register assembly 10, the shadow vanes 37 appear to substantially completely close the outlet opening (except for the burner nozzle.) Because the shadow vanes thus substantially completely cover a plane perpendicular to the axis of the burner register assembly at the outlet opening (except for the burner nozzle), they will reflect much of the radiant energy of the furnace back to the furnace to prevent it from damaging the air register assembly, particularly when the associated burner is idle. Of course, even though the shadow vanes substantially cover the aforementioned plane, they do not substantially close the outlet opening with respect to air flow. The secondary air will enter the outlet in vortex flow pattern, and the shadow vanes will be disposed at angles roughly corresponding to the direction of vortex flow. Thus, they do not substantially restrict the flow of secondary air through the outlet. In other words, pressure drops across the shadow vanes are as small as possible, preferably negligible.

As illustrated in FIGS. 1 and 2, the individual shadow vanes 37 may preferably be in the form of generally trapazoidal fins having two opposed converging edges spaced in an axial direction with respect to the axis of the burner register assembly and the other two opposing edges generally parallel and radially spaced with respect to the axis.

The shadow vanes 37 function to protect the air register, and particularly the swirl vane assembly 24, from the radiant heat of the furnace when the burner 40 is idle. In the prior art, considerable air had to be directed through the secondary air supply to protect the air register from damage due to the intense heat of the furnace when the burner was idle. The capacity to provide this air required large amounts of capital equipment expenditures and operating energy expenditures for compressors, fans, cleaners, extractors, etc. This increased volume of air required t protect the prior art air registers added to the erosion damage of the furnace components located within the furnace gas flow. Moreover, this protective air represents waste gas which adversely influences the efficiency of the furnace by simply venting from the furnace much of the heat generated in the form of heated waste gas.

With burner register assembly 10, the amount of air flow needed to protect the air register assembly of an idle burner is significantly decreased from the prior art devices not utilizing shadow vanes, thus resulting in considerble cost and energy savings. The saving is especially significant when the furnace is operating at low load as in the case of utility generating stations whose load factor varies considerably over the course of a day.

Figure 3:
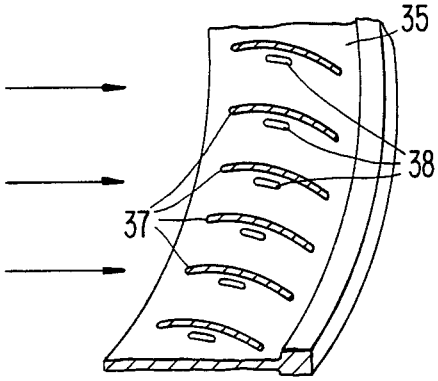
FIG. 3 is a fragmentary, detailed, sectional view of the shadow vane assembly showing the portions of the shadow vanes attached to the mounting ring and showing the associated cooling air passages for the shadow vanes.

Shadow vanes 37 have an air foil shape as best seen in FIG. 3. The air foil shape of the shadow vanes will equalize flows overall, there being a high pressure on one side of each vane 37 and low pressure on the other, i.e., the portion of the vane which would tend to be the "top" of an aircraft wing creates a low pressure, but this is produced in the same space between vanes as the underside where there would tend to be a high pressure. These pressures tend to even out and, in the process, will keep the burner register from overheating, even if the burner register is shut down and does not have a constant flow of air therethrough.

Each shadow vane 37 has a cooling air passage 38 associated therewith, which cooling air passage 38 communicates with the supply of secondary air. The secondary air flows through the cooling air passage to cool the vanes of the shadow vane assembly and thereby ensure that the shadow vane assembly will not itself be damaged by radiant heat from the furnace.

In operation, primary air and fuel enter the furnace through burner 40 and are conventionally injected through adjustable diffuser nozzle 44 having diffuser elements 46. As will be apparent from the foregoing and from the drawing, the body 12 of the air register 10 surrounds the fuel and primary air nozzle 44; that is, the fuel and primary air nozzle 44 is mounted in a axial opening 47 in body 12.

As already indicated, secondary air enters the inlets 15*a*, 15*b*. The volume of secondary air introduced is controlled by the air valves 13*a*, 13*b*. The secondary air then passes through the scroll sections 22*a*, 22*b* and is evenly distributed about the swirl vane assembly 24 in an organized manner. The air then passes through the low pressure drop swirl vane assembly 24 where a well-defined vortex is maintained.

The vortex of secondary air entrains the injected primary air and fuel and carries it well out into the furnace, past the shadow vanes 37. The shadow vanes may also operate to impart an additional directional component to the flow to modify the vortex depending upon the nature and quality of the fuel or other variables, thus resulting in enhanced fuel burning, increased furnace efficiency and less pollution generation.

The foregoing description of the preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A burner register assembly for controlling a supply of secondary air to a furnace having a fuel and primary air supply and a secondary air supply, the register assembly comprising:

(a) a body, (b) a pair of air valves in said body communicating with the secondary air supply to control the admission of secondary air to the register assembly, and (c) a pair of scroll sections in said body;

(d) each air valve being located adjacent an upstream end of one of said scroll sections in said body such that an air valve is disposed adjacent an entrance to each scroll section, each said scroll section defining a scroll passageway which spirals inwardly in the direction of secondary air flow to effect a controlled flow pattern of secondary air into the furnace.

2. The burner register assembly of claim 1, wherein said body has a pair of inlets, through which inlets secondary air flows during operation, and an outlet through which secondary air is discharged to the furnace during operation, one of said air valves of said pair of air valves being disposed at one of said inlets of said pair of inlets, the other air valve of said pair of air valves being disposed at the other of said inlets of said pair of inlets.

3. The burner register assembly of claim 1, further including a swirl vane assembly for receiving swirling air from each of the scroll sections and directing said swirling air toward the furnace.

* * * * *